United States Patent [19]

Chicoine et al.

[11] 4,329,756

[45] May 18, 1982

[54] HOT WATER EXTRACTION CARPET AND FLOOR CLEANING MACHINE

[76] Inventors: Russell G. Chicoine, 4101 W. 59th St.; Salvatore L. Medici, 5919 S. Karlov, both of Chicago, Ill. 60629

[21] Appl. No.: 165,613

[22] Filed: Jul. 3, 1980

[51] Int. Cl.[3] ..... A47L 7/00

[52] U.S. Cl. ..... 15/321; 15/322; 15/353; 417/199 A

[58] Field of Search ..... 15/320, 321, 322, 353; 417/425, 199 A

[56] References Cited

U.S. PATENT DOCUMENTS

| | | | |
|---|---|---|---|
| 2,175,644 | 10/1939 | Replogle | 15/336 |
| 2,923,956 | 2/1960 | Bixler | 15/321 X |
| 2,999,258 | 9/1961 | Berberian | 15/321 X |
| 3,494,343 | 2/1970 | Nutten | 417/425 X |
| 4,075,733 | 2/1978 | Parise et al. | 15/322 |
| 4,146,944 | 4/1979 | Pinto | 15/321 |
| 4,156,952 | 6/1979 | Lynch | 15/322 X |

FOREIGN PATENT DOCUMENTS

| | | | |
|---|---|---|---|
| 2842533 | 2/1980 | Fed. Rep. of Germany | 15/321 |

*Primary Examiner*—Chris K. Moore

*Attorney, Agent, or Firm*—James E. Tracy

[57] ABSTRACT

The disclosed hot water extraction cleaning machine employs a conventional canister-type wet/dry vacuum cleaner having a suction tool communicating through a wand and a suction hose to a recovery tank in the vacuum cleaner. Hot cleaning solution, held in a supply tank or reservoir mounted on the wand, is pumped under pressure to a spray nozzle, positioned adjacent to the suction tool, in order to spray a jet of atomized cleaning solution onto an area of the carpet material or floor material to be cleaned. As the operator draws the suction tool across the sprayed area, the cleaning solution, with entrained dirt from the material, is sucked into the recovery tank. A hand-controlled valve permits the operator to control the flow of cleaning solution to the spray nozzle.

1 Claim, 6 Drawing Figures

FIG. 1
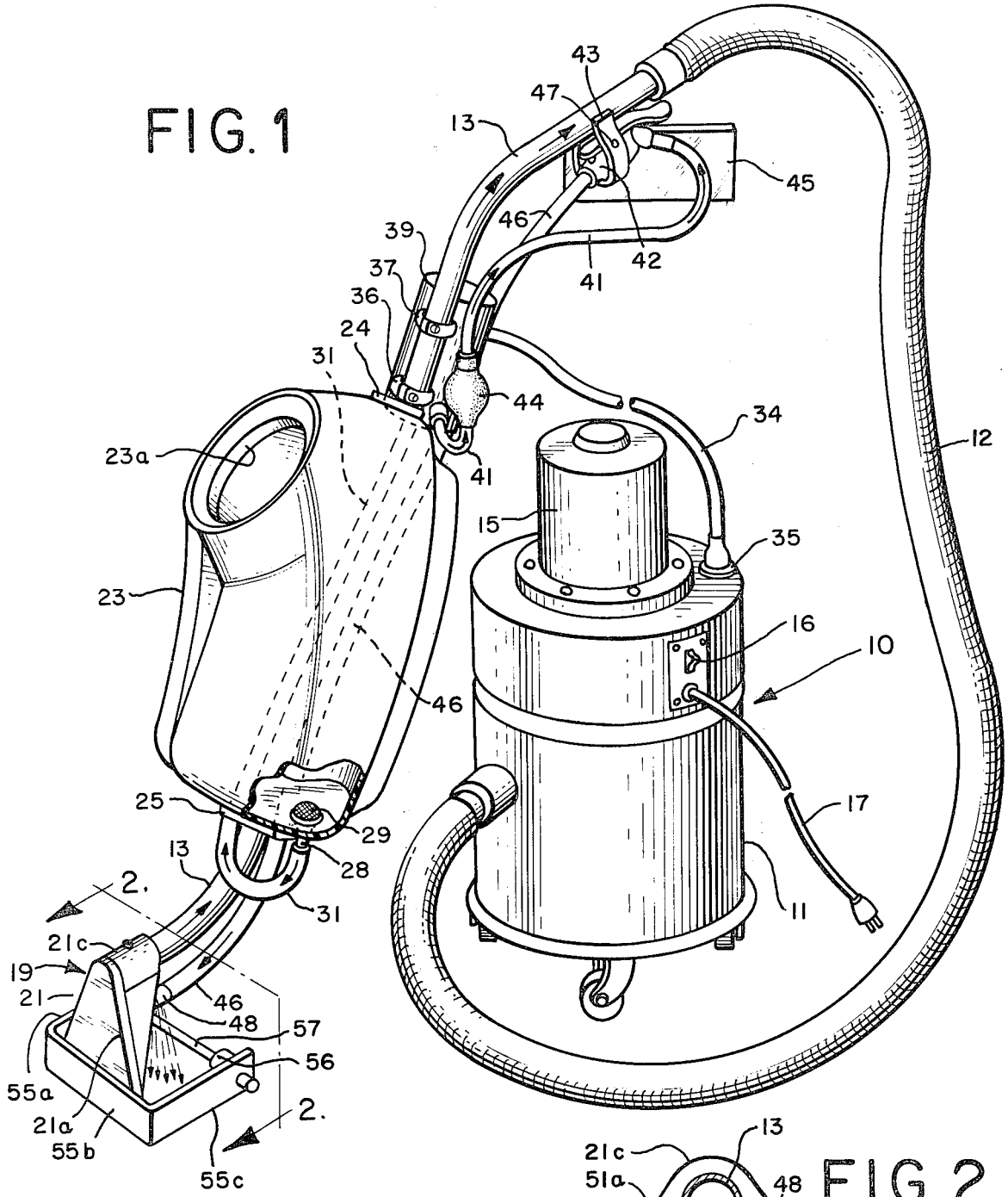
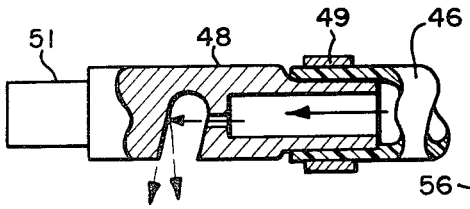
FIG. 2a
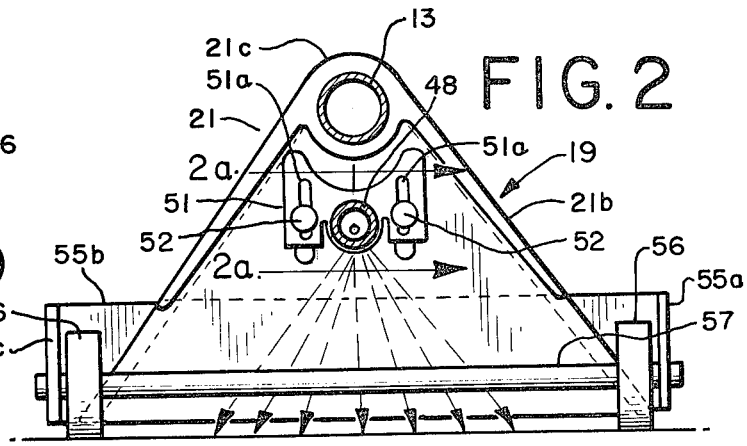
FIG. 2

HOT WATER EXTRACTION CARPET AND FLOOR CLEANING MACHINE

BACKGROUND OF THE INVENTION

This invention relates to a hot water extraction system for cleaning carpets and floors of all types and materials.

In prior extraction systems, separate supply and recovery tanks are provided in a movable, floor-supported carrier unit and a cleaning solution (comprising hot water and a detergent or a cleaning chemical) is pumped from the supply tank to a nozzle and sprayed onto the floor or carpet to be cleaned. The spent solution, together with dirt from the floor or carpet, are then picked up or extracted by a suction tool and vacuumed through a suction hose to the recovery tank. In one of these prior systems, the supply tank has a special shape so that it may be attached to and interfaced with a particular canister-type wet/dry vacuum cleaner, thereby effectively converting that vacuum cleaner to a hot water extraction cleaning system. Unfortunately, the water extraction apparatus can be used with only the specific vacuum cleaner for which it was designed. No other vacuum cleaner can be substituted. This means that if a person desires to buy such a hot water extraction cleaning system, all of the equipment must be purchased, including the particular vacuum cleaner to which the accessory apparatus is married. This is true even though the person may already own a canister-type wet/dry vacuum cleaner of some other design.

The present invention also provides accessory apparatus for converting a canister-type wet/dry vacuum cleaner into a hot water extraction cleaning system. However, unlike the prior system, the present invention can be used with any conventional canister-type wet/dry vacuum cleaner. This, of course, constitutes a significant improvement over the prior art.

Moreover, the unique design of the present extraction system results in other advantages, to be made apparent, over the prior systems.

SUMMARY OF THE INVENTION

The hot water extraction carpet and floor cleaning machine of the present invention comprises a canister-type wet/dry vacuum cleaner having a wand one end of which is connected, via a suction hose, to a recovery tank. A cleaning head, which is attached to the other end of the wand and is adapted to be moved by the operator over the material to be cleaned, has a suction tool to facilitate extraction of liquid from the material and delivery of that liquid to the recovery tank. A supply tank is attached to and supported on the wand for holding a hot cleaning solution. The cleaning head also includes a spray nozzle which is mounted adjacent to the suction tool. Finally, the cleaning machine comprises means, including a liquid supply line and an electrically powered fluid pump, for supplying cleaning solution under pressure from the supply tank to the spray nozzle in order that a jet of atomized cleaning solution may be sprayed onto an area of the material to be cleaned, after which the solution and the entrained dirt therein may be drawn off from the material and sucked into the recovery tank as the suction tool is moved across the sprayed area.

DESCRIPTION OF THE DRAWINGS

The features of the invention which are believed to be novel are set forth with particularity in the appended claims. The invention, together with further advantages and features thereof, may best be understood, however, by reference to the following description in conjunction with the accompanying drawings in which like reference numbers identify like elements, and in which:

FIG. 1 is a perspective view of a complete hot water extraction cleaning machine constructed in accordance with one embodiment of the invention and incorporating a conventional canister-type wet/dry vacuum cleaner;

FIG. 2 is a sectional view taken along the section line 2—2 in FIG. 1;

FIG. 2*a* is a fragmentary sectional view taken along the section line 2*a*—2*a* in FIG. 2;

FIG. 3 specifically shows the accessory apparatus that may be used with any conventional canister-type wet/dry vacuum cleaner to convert the vacuum cleaner to a hot water extraction cleaning system;

DESCRIPTION OF THE ILLUSTRATED EMBODIMENT

Figures 3, 4, 5:
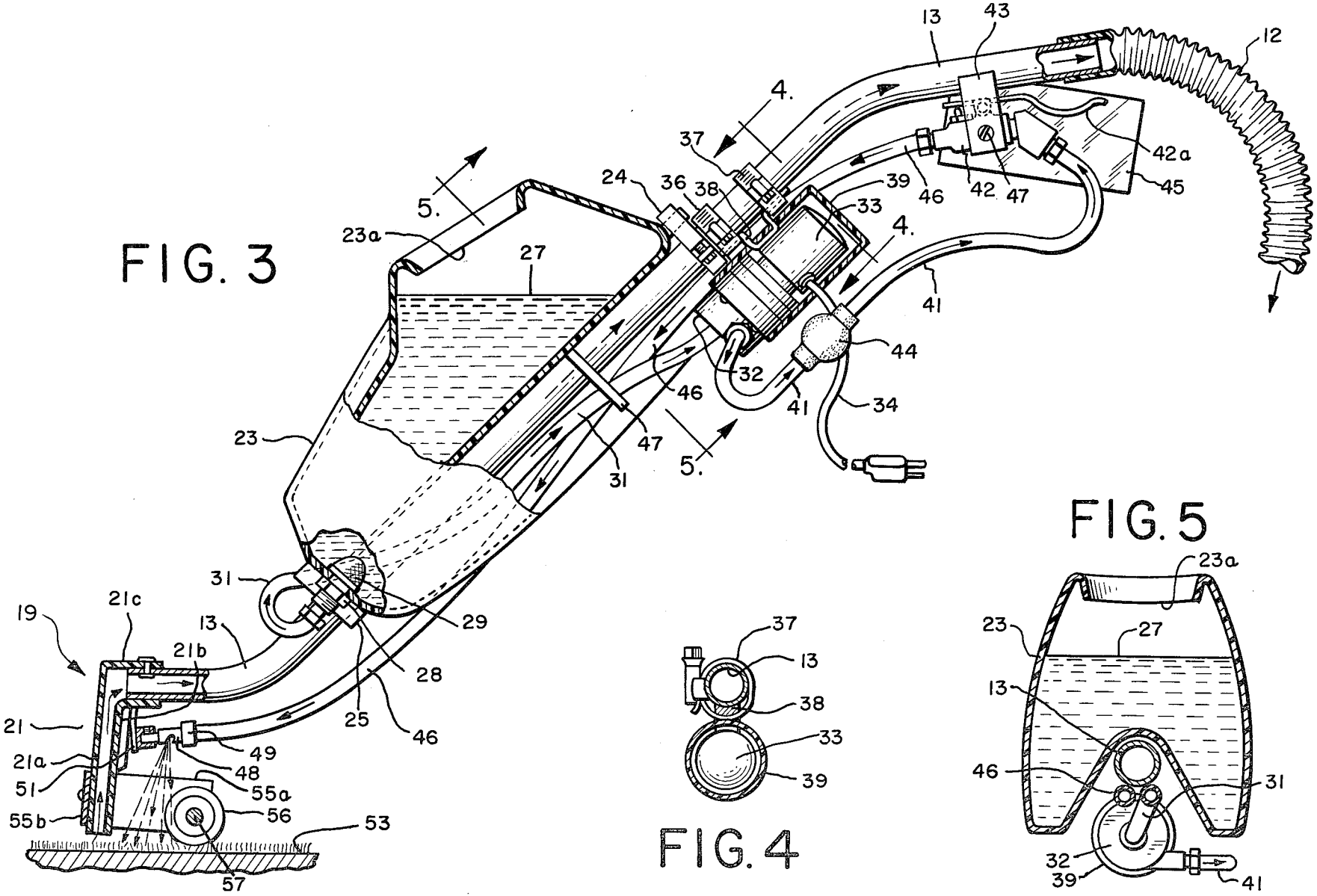
FIG. 3 is a side view, partially broken away, of a portion of the cleaning machine of FIG. 1.
FIG. 4 is a fragmentary sectional view taken along the section line 4—4 in FIG. 3.
FIG. 5 is a fragmentary sectional view taken along the section line 5—5 in FIG. 3.

Reference numeral 10 designates a conventional canister-type wet/dry vacuum cleaner having a recovery tank 11 whose suction inlet is coupled by a flexible suction hose 12 to a relatively rigid wand 13, preferably made of stainless steel. The motor 15 of the vacuum cleaner is energized under the control of off-on switch 16 when, of course, power cord 17 is plugged into a grounded wall outlet to receive 115 volts AC line voltage. As will be made apparent, the invention may be practiced with any conventional canister-type wet/dry vacuum cleaner. All that is necessary is for the vacuum cleaner to have the capability of picking up liquid and delivering it through the wand and suction hose to the recovery tank where it may be accumulated and subsequently dumped out and disposed of.

Secured to the free end of wand 13 is a suction tool 21 which forms part of a cleaning head 19. More specifically, suction tool 21 comprises a pair of spaced-apart parallel wall sections 21*a* and 21*b* to provide a triangular shaped vacuum chamber which communicates with the conduit formed by wand 13. Preferably, suction tool 21 is fabricated of transparent plastic (particularly top section 21*c* ) to permit visual observation of the liquid and dirt picked up by the vacuum cleaner. Top section 21*c* should be transparent since it can easily be seen by the operator of the cleaning machine. Hence, the dirt and liquid flowing through suction tool 21 and into wand 13 may easily be viewed by the operator.

In order to provide a reservoir for storing a hot cleaning solution, in accordance with a salient feature of the invention a supply tank 23 is rigidly attached to and supported on wand 13 by means of a pair of clamps 24 and 25. In the illustrated embodiment, supply tank 23 partially wraps around wand 13. This is best seen in FIG. 5. Tank 23 is preferably fabricated of plastic, such as polyethylene, and has a relatively large inlet 23*a* to allow the tank to be filled with a hot cleaning solution 27. An outlet 28, covered by a filter screen 29, is provided at the bottom of supply tank 23 and a liquid line 31, which may be plastic tubing, connects outlet 28 to the inlet of an electrically powered fluid pump 32, see FIG. 3.

More particularly, pump 32 is driven or rotated by an electric motor 33 which is energized, via power cord 34, by a source 115 volts AC line voltage. In the illustrated case, the necessary line voltage may be obtained from vacuum cleaner 10. Power cord 34 is therefore shown plugged into a grounded outlet 35 on the vacuum cleaner, see FIG. 1. Alternatively, cord 34 may be plugged into any convenient 115 volts AC grounded wall outlet. The advantage of deriving the pump motor energizing voltage from the vacuum cleaner is that both the pump and vacuum cleaner may be turned on and off at the same time merely by operating a single switch, namely switch 16. Pump 32 will thus operate continuously as long as line voltage is applied to motor 33. The motor-pump assembly 32, 33 is affixed to and supported on wand 13 by means of a pair of clamps 36 and 37 and a holding bracket 38. A plastic protective cover or shield 39 fits over the motor-pump assembly and is held in place by bracket 38.

The outlet of pump 32 couples via a liquid line 41 (which also may take the form of plastic tubing) to the inlet of a manually operated control valve 42 which is rigidly secured to wand 13 by U-shaped bracket 43. Valve 42 is normally closed but may be opened by the operator by moving lever arm 42*a* toward wand 13. When lever arm 42*a* is released, the arm automatically returns to its normal position and the valve closes.

In series with line 41 is a primer 44 which consists of a resilient or rubber-like ball that may be squeezed by the operator. Plastic support bracket 45 pivotally attaches to bracket 43 and valve 42 (by means of bolt 47 and a nut, not shown) and allows wand 13 and all of the apparatus secured thereto (with the exception of suction hose 12) to lean against a wall when the cleaning machine is not in use. In addition, by pivoting bracket 45 slightly clockwise from its position shown in FIG. 3, the bracket will serve as a rest if it is desired to lay the cleaning machine on the floor when not being used.

The outlet of valve 42 is coupled through liquid line 46, preferably in the form of plastic tubing, to a spray nozzle 48 which is included in cleaning head 19 and is mounted adjacent to suction tool 21. A plastic strap 47 (see FIG. 3) ties liquid lines 31 and 46 to wand 13. As best seen in FIG. 2*a*, one end of spray nozzle 48 is securely fastened to tubing 46 by means of a clamp 49. The other end of nozzle 48 is rigidly affixed to a bracket assembly 51 which in turn is adjustably attached to wall section 21*b* of the suction tool by means of a pair of hand-operated screws 52, see FIG. 2. Note that screws 52 extend through vertically-aligned longitudinal slots 51*a* in the bracket assembly. This permits vertical adjustment of spray nozzle 48 relative to suction tool 21. When hot cleaning solution is pumped through liquid line 46 to nozzle 48, a jet of atomized cleaning solution will be sprayed in the manner indicated by the arrows emanating from nozzle 48 in FIGS. 1, 2, 2*a* and 3. Assuming that cleaning head 19 is established in the position illustrated in FIG. 3 and overlies carpet material or floor material which is to be cleaned (carpeting 53 is specifically shown in FIG. 3), the jet spray from nozzle 48 will cover an impact area, on the material, determined by the height of the nozzle from the material. The higher the nozzle, the larger the impact area. It has been found that the best results are achieved by lowering bracket assembly 51, and consequently nozzle 48, to their lower most position for low pile, indoor/outdoor carpeting, tile, linoleum floors and the like. On the other hand, for deep shag carpets the best results are obtained when nozzle 48 is in its upper most position. For medium height carpets, the nozzle should be midway between its lowest and highest positions.

Cleaning head 19 also includes a U-shaped retaining wall, which comprises three sections 55*a*, 55*b* and 55*c*, for partially surrounding the impact area of the jet of atomized cleaning solution in order to minimize any splashing of that solution onto adjacent areas, thereby confining the cleaning solution to the area being cleaned. Splash prevention is particularly desirable when carpeting is being cleaned immediately adjacent to furniture. Wall section 55*b* is secured (such as by screws) to wall section 21*a* of the suction tool 21. Rolling or moving the cleaning head over the material to be cleaned is facilitated by a pair of wheels 56 rotatably mounted on an axle 57 held by wall sections 55*a* and 55*c*.

To operate the cleaning machine, supply tank 23 must initially be filled, through inlet 23*a*, with a hot cleaning solution 27, namely a mixture of hot water and a detergent or some cleaning chemical. Power cord 17 should be plugged into a 115 volt AC wall outlet, while cord 34 is plugged into outlet 35 or another wall outlet. With switch 16 turned on, vacuum cleaner 10 will now operate and produce a vacuum for providing suction into recovery tank 11. At the same time, motor 33 will operate to rotate pump 32 and cause cleaning solution to be pumped under pressure from supply tank 23 and through liquid lines 31 and 41 to the inlet of control valve 42. When lever arm 42*a* is actuated by the operator in the direction toward wand 13, the pressurized cleaning solution will be delivered through the valve and through liquid line 46 to spray nozzle 48. In the event that the pump requires priming, this can easily be accomplished merely by squeezing primer 44. This is a well known arrangement for priming a liquid pump.

With the cleaning machine now fully operable, wand 13 may be manipulated by the operator to roll the cleaning head slowly back and forth over a section to be cleaned. As cleaning head 19 is drawn toward the operator (namely, to the right as viewed in FIG. 3), lever arm 42*a* will be actuated to supply pressurized cleaning solution to nozzle 48 in order that a jet of atomized cleaning solution will be sprayed onto an area of the carpet material or floor material to be cleaned. Since suction tool 21 is moving toward the sprayed area, the spent solution and dirt from the material, which becomes entrained in the solution, will be immediately extracted from the material and sucked through wand 13 and hose 12 to recovery tank 11 as the suction tool moves across the sprayed area. Of course, the number of passes that must be made over a given area to thoroughly clean that area depends on many factors, such as the extent to which the material is soiled, the strength of the cleaning solution, the performance rating of the vacuum cleaner, etc.

It should now be apparent that since the supply tank and the motor-pump assembly are mounted on the wand, any canister-type wet/dry vacuum cleaner may be employed to practice the invention. Moreover, the weight of the apparatus supported on wand 13 provides an additional advantage over prior hot water extraction systems, particularly when carpeting is being cleaned.

This weight bears down on suction tool 21, effectively pressing or forcing it well down into the carpeting and increasing the suction action. This is especially helpful in cleaning deep shag carpets. Of course, the amount of cleaning is maximized by maximizing the amount of dirty cleaning solution extracted from the carpeting. By observing, particularly through transparent section 21*c*, the color of the solution being extracted, the operator may repeat the cleaning process until the solution is clean as it flows through the suction tool. Thereafter, vacuuming should continue until only air appears to be passing through suction tool 21.

While a particular embodiment of the invention has been shown and described, modifications may be made, and it is intended in the appended claims to cover all such modifications as may fall within the true spirit and scope of the invention.

We claim:

1. A hot water extraction carpet and floor cleaning machine, comprising:

a canister-type wet/dry vacuum cleaner including a power cord to be plugged into a source of AC line voltage, an outlet for providing the AC line voltage when the power cord is plugged in, and a relatively rigid wand one end of which is connected, via a suction hose, to a recovery tank in the vacuum cleaner;

a cleaning head, attached to the other end of said wand and having a pair of wheels to facilitate rolling of the cleaning head, by the operator, over the carpet material or floor material to be cleaned, and further having a suction tool to facilitate extraction of liquid from the material and delivery of that liquid to the recovery tank;

a supply tank, partially wrapped around and attached to and supported on said wand, for holding a relatively large quantity of a hot cleaning solution;

a spray nozzle included in said cleaning head and mounted adjacent to said suction tool;

an electric motor-driven fluid pump attached to and supported on said wand and positioned above said supply tank in order to preclude the possibility of the hot cleaning solution being accidentally spilled on the pump motor when the supply tank is being filled, the pump motor having a power cord adapted to be plugged into said outlet on said vacuum cleaner in order to receive AC line voltage to effect energization of the motor, thereby permitting both the pump motor and the vacuum cleaner to be turned on and off at the same time merely by operating a single switch on the vacuum cleaner;

means, including said fluid pump and a liquid supply line, for supplying cleaning solution under pressure from said supply tank to said spray nozzle in order that a jet of atomized cleaning solution may be sprayed onto an area of the material to be cleaned, after which the solution and the entrained dirt therein may be drawn off from the material and sucked into said recovery tank as said suction tool is moved across the sprayed area, at least a portion of said suction tool being transparent to provide visual observation of the amount of dirt entrained in the cleaning solution removed from the material and vacuumed into said recovery tank, the position of said spray nozzle being adjustable relative to said suction tool to vary the area of impact of the jet of atomized cleaning solution on the material to be cleaned;

a retaining wall, included in said cleaning head, which at least partially surrounds the impact area of the jet of atomized cleaning solution to minimize any splashing of that solution onto adjacent areas;

a primer, in the form of a resilient ball, in series with said liquid supply line and which may be squeezed by the operator to prime said pump;

and an adjustably positioned plastic bracket, supported by the end of said wand which is adjacent to said suction hose, for permitting the wand, and the apparatus attached thereto, to lean against a wall or to rest on a floor when the cleaning machine is not in use.

* * * * *